United States Patent [19]

Breed

[11] 3,974,350

[45] Aug. 10, 1976

[54] GAS DAMPED VEHICULAR CRASH SENSOR WITH GAS BEING DOMINANT BIASING FORCE ON SENSOR

[75] Inventor: David S. Breed, Boonton, N.J.

[73] Assignee: Breed Corporation, Fairfield, N.J.

[22] Filed: July 24, 1974

[21] Appl. No.: 491,291

[52] U.S. Cl. ..... 200/61.53; 102/70 S

[51] Int. Cl.[2] ..... H01H 35/14

[58] Field of Search ..... 73/510, 514, 517 R, 73/521, 522, 526; 200/61.44, 61.45 R, 61.52, 61.53; 102/705, 78

[56] References Cited

UNITED STATES PATENTS

| | | | |
|---|---|---|---|
| 2,243,621 | 5/1941 | Denoix | 102/705 UX |
| 2,801,589 | 8/1957 | Meek et al. | 102/78 |
| 2,921,999 | 1/1960 | Ziegler, Jr. | 200/61.53 X |
| 3,508,019 | 4/1970 | Crockett | 200/61.45 R |
| 3,602,049 | 8/1971 | Albert | 200/61.53 X |
| 3,703,866 | 1/1972 | Semenza | 102/705 |
| 3,715,535 | 2/1973 | Vrenda | 200/61.53 |
| 3,771,457 | 11/1973 | Buxton | 200/61.45 R X |
| 3,793,498 | 2/1974 | Matsui et al. | 200/61.53 X |
| 3,859,483 | 1/1975 | Laserson et al. | 200/61.53 X |
| 3,889,130 | 6/1975 | Breed | 200/61.53 X |

*Primary Examiner*—James R. Scott

[57] ABSTRACT

A sensor for sensing deceleration of a vehicle and actuating a passenger protective device comprises a sealed, gas filled housing containing a cylinder and a piston within the cylinder movable in response to deceleration of the vehicle. A clearance between the piston and the cylinder is so selected that the movement of the piston is damped by the gas. The gas flow is viscous resulting in a sensor responsive to a constant velocity change of the vehicle above a prescribed threshold, regardless of the shape or duration of the crash pulse.

16 Claims, 4 Drawing Figures

GAS DAMPED VEHICULAR CRASH SENSOR WITH GAS BEING DOMINANT BIASING FORCE ON SENSOR

BACKGROUND OF THE INVENTION

Three types of vehicular crash sensors have been considered for use in the deployment of passenger restraint systems such as air bags. One is an electronic sensor which is objectionable because of the high incidence of inadvertent operation arising out of spurious electrical signals associated with an automobile. The second is a spring mass sensor which to date has achieved the widest acceptance. The third is a sensor based on inertial flow of a liquid such as that described in co-pending application Ser. No. 366,427, filed June 4, 1973, now U.S. Pat. No. 3,889,130.

The spring mass sensors currently in use have been effective with crash pulses of extremely short durations. Such pulses are characteristic of head-on crashes or standard barrier impacts. In the case of pulses which are of much longer duration, such as are typical of angular impacts or crashes into energy absorbing guard rails, fences, or wooded areas containing small diameter trees, the spring mass sensors currently utilized may not be capable of functioning with the result that the occupants of the vehicle could be seriously injured. One typical spring mass sensor, for example, underwent a crash involving a 60 m.p.h. velocity change during a time period of 0.2 second, but was unable to effect deployment of the air bag. The occupants of a car equipped with such a sensor would be seriously injured or killed.

Inertial flow crash sensors will function reasonably well for long duration pulses, but they will not provide adequate protection when the velocity change of the vehicle is of extremely short duration. Such sensors, therefore, cannot be utilized on the bumper of a vehicle where the crash pulse tends to be of very short duration. However, they do function well when placed farther back in the vehicle.

Although there is disagreement as to the exact manner in which an optimum crash sensor should function, a sensor which is responsive to a given velocity change of the vehicle, providing the velocity change takes place substantially above a fixed deceleration level, appears to be most satisfactory. Such a sensor should respond to pulses of both short and long duration and should be relatively independent of the shape of the acceleration pulse. One technique by which these characteristics can be achieved is described herein.

In cases where a crash sensor is mounted near the front of the vehicle and receives the maximum pulse corresponding to a given velocity change, spring mass sensors may become excessively large since the travel of the sensing mass must be quite long. In a gas damped crash sensor according to the invention, however, the travel of the sensing mass can be controlled by varying the damping force, thereby resulting in a much smaller and thus less expensive crash sensor.

SUMMARY OF THE INVENTION

A vehicular crash sensor according to the invention comprises a cylinder containing a sensing piston which is movable within the cylinder to effect operation of a restraint device in response to the deceleration of the vehicle. A gas fills the cylinder and exerts a viscous damping force on the piston. A bias force also acts on the piston, but during a typical crash the force exerted on the piston by the gas is significantly larger than the bias force.

A primary object of this invention is to provide a vehicular crash sensor which responds to a constant velocity change for short duration pulses and to a slowly increasing velocity change for long duration pulses.

Another object of this invention is to provide a small size crash sensor for use on a vehicle bumper.

A further object is to provide a relatively inexpensive crash sensor.

Still another object is to provide a crash sensor the response of which is relatively independent of the shape of the crash pulse.

Another object is to provide a crash sensor which has a very fast response time.

Other objects and advantages of this invention will become apparent from the following description when it is considered in conjunction with the appended claims and the accompanying drawings in which:

Figure 2:
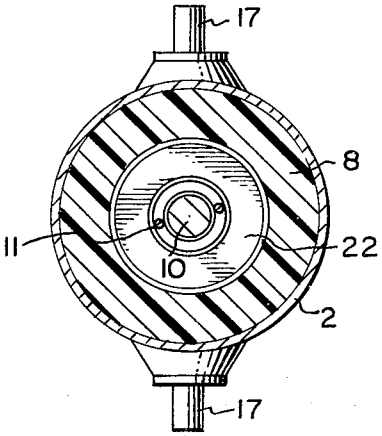
FIG. 2 is a transverse cross sectional view taken along the line 22 of FIG. 1.
Figure 1:
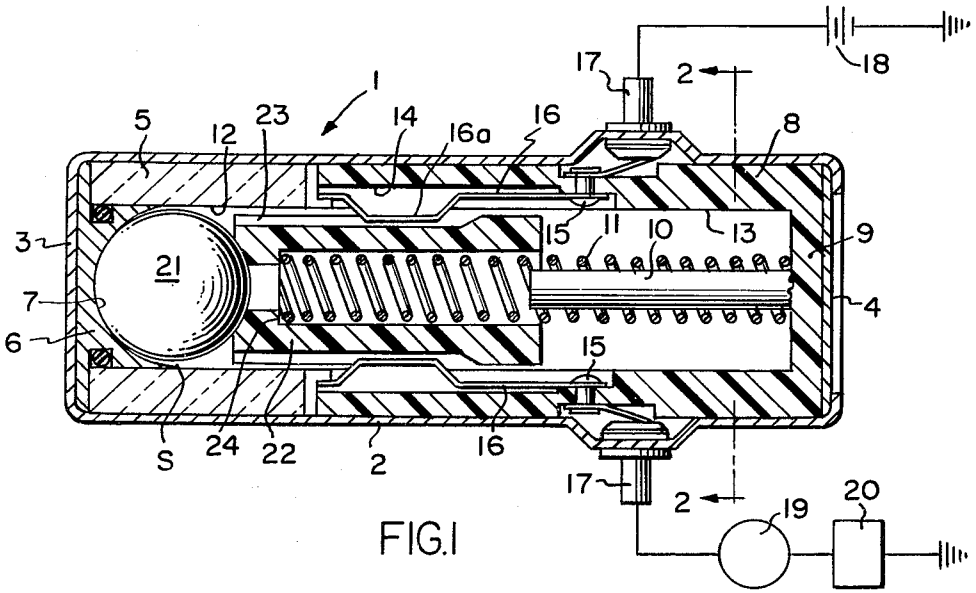
FIG. 1 is a longitudinal cross sectional view of a gas damped crash sensor according to one embodiment of the invention.

A crash sensor constructed according to the embodiment of the invention shown in FIG. 1 and 2 is designated generally by the reference character 1 and comprises a hermetically sealed, metal housing 2 filled with a gas such as helium. The housing is closed at one end by an integral wall 3 and at the opposite end by a disc 4 that is welded or otherwise secured to the housing. Within and adjacent one end of the housing is an electrically non-conductive, preferably glass cylinder 5 which bears at one end against an end member 6 having a semi-spherical seat 7. Also accommodated within the housing 2 is a non-conductive, cup-shaped retaining cylinder 8 having one end closed by a wall 9 which bears against the disc 4. Integral with the wall 9 is a guide stem 10 which receives a biasing spring 11.

The cylinder 5 has a uniform diameter, smooth bore 12 confronting the bore 13 of the cylinder 8. The bore 13 is provided with slots 14 which extend axially to the open end of the cylinder 8 and form a chamber having an effective volume greater than that of the bore 12. Fixed in the slots 14 by means of conductive rivets 15 is a pair of conductive, actuating switch blades 16 having diametrically opposed contact portions **16*a* which extend into the bore 13. The blades 16 are connected via the rivets 15 and wiring to terminals 17 carried by and insulated from the housing 2. One of the terminals 17 is connected to a battery 18 or other source of electrical energy, and the other terminal is connected to an operator 19 of known construction that is operable to activate a passenger restraining device 20** such as an inflatable air bag.

Fitted into the bore 12 of the cylinder 5 is an electrically conductive, spherical sensing mass or piston 21 having a diameter corresponding substantially to the curvature of the seat 7. The diameter of the piston 21 is greater than the diametral spacing between the contacts **16*a***, but is less than the diameter of the bore 12 to provide a clearance or space S for a purpose which will be explained hereinafter.

Slidably accommodated in the bore 13 of the retaining cylinder 8 is an axially bored biasing mass or tube 22 having external grooves 23 in which the contacts 16*a* of the blades 16 are accommodated. The biasing spring 11 extends into the tube 22 and seats against a shoulder 24. The spring 11 normally maintains the tube 22 in engagement with the piston 21 and the latter in engagement with the seat 7 of the end member 6.

To condition the sensor 1 for operation, it is secured to a vehicle in any convenient manner with the closure disc 4 facing forwardly of the vehicle and the terminals 17 connected respectively to the energy source 18 and the actuator 19.

When the vehicle on which the sensor 1 is mounted experiences a deceleration pulse greater than the biasing force exerted by the spring 11 on the tube 22, such as would accompany a crash, the bias tube 22 is capable of moving rapidly toward the forward end of the vehicle, collapsing the spring 11, until the tube bottoms in the retaining cylinder 8. Simultaneously, the sensing piston 21 begins to move forwardly of the housing 2, but after a slight forward motion of the piston a partial vacuum is formed between it and the end member 6. A pressure differential thus is created across the sensing piston and produces a damping force which opposes movement of the piston forwardly of the vehicle. Gradually, however, the gas within the housing 2 leaks past the piston 21 at a rate that is determined by the clearance S between the cylinder 5 and the piston 7. The rate of gas leakage, and consequently, the rate of movement of the piston are determined and controlled in a manner hereinafter described.

If the deceleration pulse is of sufficient duration and magnitude, the sensing piston 21 will move forwardly of the vehicle a distance sufficient to emerge from the bore of the cylinder 5 and enter the cylinder 8. Since the effective volume of the bore 13 of the retaining cylinder 8 is greater than that of the bore 12 of the cylinder 5, movement of the piston 21 into the cylinder enables gas to flow past the piston at a much faster rate, thereby enabling forward movement of the piston to accelerate into bridging engagement with the contacts 16*a* of the blades 16 and establish an electrical circuit between the source 18 and the operator 19, activating the restraint device 20.

The movement of the biasing mass 22 into bottoming engagement with the cylinder 8 is greater than is required to enable engagememnt of the piston 21 with the contacts 16*a*. Consequently, the piston is able to traverse a substantial portion of the contacts 16*a* and thereby provide a prolonged engagement between the contacts and the piston.

If the deceleration pulse to which the sensor 1 is subjected is of insufficient duration or magnitude to effect movement of the piston 21 from the cylinder 5 into the cylinder 8, decay of the pulse will enable the bias spring 11 to restore the members 21 and 22 to their initial, normal positions.

A typical crash sensor of the kind disclosed in FIGS. 1 and 2 has a precision glass cylinder 5 and a low expansion nickel alloy sensing piston 21 having a diameter between one-quarter and one-half inch. The clearance S between the piston and the cylinder is chosen to provide for viscous flow of the gas through the clearance S, to provide the desired rate of longitudinal movement of the piston, and to effect temperature compensation as hereinafter described. Typically, the clearance is between 0.0005 inch and 0.01 inch.

Figure 3:
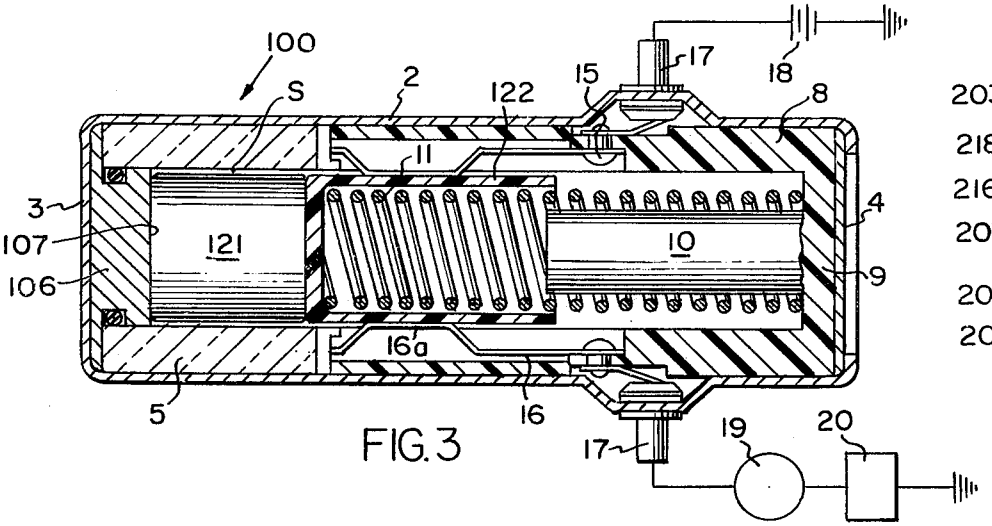
FIG. 3 is a view similar to FIG. 1, but illustrating a modified embodiment.

The sensor 100 of the FIG. 3 embodiment is similar to that previously described, and similar parts are identified by similar reference characters. In the embodiment of FIG. 3, the end member 106 has a flat seat 107 against which one end of an electrically conductive, cylindrical sensing piston 121 normally rests. The other end of the piston constantly bears against a thimble-shaped biasing member 122 in which the biasing spring 11 is received.

The operation of the sensor 100 is similar to that of the sensor 1, the principal difference being that the constant engagement between the members 121 and 122 enables the biasing spring 11 to act constantly on the sensing piston 121. The clearance S between the sensing piston 121 and the sleeve 5 thus may be somewhat larger than that between the members 5 and 21 of the FIG. 1 embodiment, but the size of the clearance nevertheless should be such as to provide for viscous gas flow. A larger clearance may cause the sensor to be affected by pulses perpendicular to its longitudinal axis, thereby giving rise to friction forces acting on the sensing mass. Accordingly, the clearance should not be so large as to minimize substantially the overall accuracy of the sensor.

Figure 4:
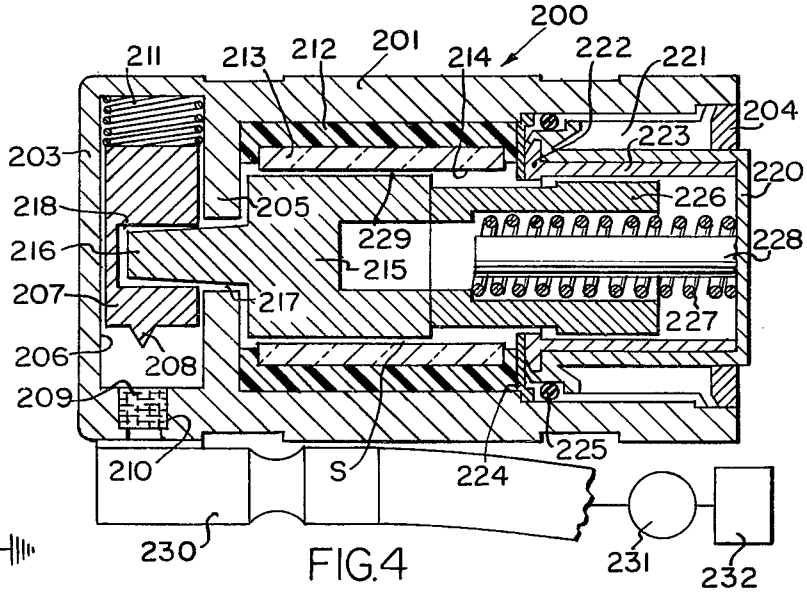
FIG. 4 is a view similar to FIG. 1, but illustrating a crash sensor having a pyrotechnic output.

FIG. 4 discloses a viscous damping sensor 200 having a pyrotechnic means for operating a passenger restraint device. The sensor comprises a gas filled, metal housing 201 closed at one end by a wall 203 and at the opposite end by an annular closure 204. Adjacent the wall 203 is a partition 205 which defines a cavity 206 in which is accommodated an actuating slider 207. The slider has a radially projecting firing pin 208 which confronts an impact primer charge 209 that occupies an opening 210 formed in the housing 201. The slider 207 constantly is biased toward the primer 209 by a spring 211.

Seated on the partition 205 is an annular retainer 212 within which is a glass cylinder 213 having a smooth bore 214. A cylindrical sensing piston or mass 215 is received in the bore 214, the diameters of the bore and the piston 215 being sufficiently different to provide a clearance S therebetween of such size that gas flow through the clearance is viscous.

The piston 215 has an extension 216 which extends through an opening 217 in the partition 205 and is accommodated in a cavity 218 formed in the slider 207. The spring 211 normally maintains the actuating slider against the extension 216 which acts to hold the slider in a safe position. Engagement of the extension by the slider also cocks the piston 215 in the bore of the sleeve 213, as is permitted by the clearance S.

Fitted into the housing 201 is a retaining cup 220 having ribs 221 which seat at one end on the closure 204 and at the other end on a flange 222 carried by a sleeve 223 which is fitted into the cup 220. An annulus 224 is interposed between the flange 222 and the retaining cylinder 212. A sealing ring 225 encircles the inner end of the cup 220 to provide a seal for the housing 201.

A tubular biasing mass 226 is slidably accommodated in the sleeve 223 and is biased into engagement with the piston 215 by a spring 227 which encircles a guide stem 228 carried by the cup 220. The piston 215 has a recess 229 in which the stem may be accommodated when the piston moves forwardly of the sensor.

Fixed to the housing 201 adjacent the primer charge 210 is one end of a pyrotechnic detonator cord 230, the opposite end of which is connected to an explosive operator 231 which is operable to energize a passenger restraint 232 such as an inflatable air bag.

When a vehicle equipped with the sensor 200 experiences a crash sufficiently severe to require deployment of the restraint 232, the biasing mass 226 will collapse the spring 227 and move forwardly of the housing 201, thereby enabling the piston 215 also to move forwardly and withdraw the extension 216 from the cavity 218 in the slider 207. The spring 211 then will propel the slider toward the primer 209 with sufficient force to enable the firing pin 208 to detonate the primer which, in turn, initiates the detonator cord 230. Initiation of the cord 230 will effect operation of the operator 231 and deployment of the device 232.

Should the deceleration pulse of the vehicle equipped with the sensor 200 be less than is required for deployment of the device 232, the extension 216 of the piston 215 will not be withdrawn from the slider 207, and decay of the pulse will enable the spring 227 to restore the piston and its associated parts to the positions shown in FIG. 4.

The movement of the sensing piston 215 is damped by a pressure differential across the piston, but in this case the pressure differential is created by compression of the gas forwardly of the piston. That is, movement of the piston forwardly compresses the gas forwardly of the piston, whereas the relatively large volume rearwardly of the piston, due to the presence of the slider cavity 206, enables the gas pressure rearwardly of the piston to remain at or substantially close to the pressure existing in the sensor prior to the crash.

The gas used in the sensor 200 may be helium, as before, or it may be air since the cylindrical sensing piston permits the Reynolds number to approach 2000 before inertial flow effects are encountered.

In the design of gas damped deceleration sensors according to the invention, consideration has been given to viscosity variations due to temperature changes, gas compressibility, the change in ambient pressure as a function of temperature, and the inability to vary the viscosity of the gas with the result that the Reynolds numbers could become large and inertial flow could take place. Each of these points will now be considered for the spherical piston sensor of FIG. 1 as an example.

The velocity of a spherical piston moving in a cylindrical tube under a force F can be related to the pressure drop across the piston created by the force by the following equation:

$$\dot{X} = \frac{.096H^{5/2}}{uR^{3/2}} \quad \frac{P_2^2 - P_1^2}{P_1} \qquad [1]$$

where:

$\dot{X}$ = steady state piston velocity
$H$ = mean radial clearance
$u$ = viscosity of gas
$R$ = radius of piston
$P_2$ = ambient pressure
$p_1$ = pressure below piston The equation results from calculating the viscous flow rate through a slit, then integrating axially assuming a parabolic clearance profile between the sphere and the cylinder. Equation [1] applies for travel of the sphere along the side of the cylinder. If the sphere were to travel along the center of the cylinder, the velocity would be 0.52 times that given in equation [1]. From this equation, it will be observed that the compressibility effects of the gas alter the true velocity dependent damping characteristic desired. If the sensor is sealed, the velocity dependent damping can be varied by increasing the ambient pressure within the sensor.

The Reynolds number for a given flow situation is a ratio of the inertial forces to the viscous forces. If the Reynolds number is very high, then the inertial forces dominate the viscous forces and the damping force becomes proportional to the velocity squared of the sensing mass. Such would be the case, for example, if the sensing mass were a cylindrical piston containing a sharp edged orifice. With the sharp edged orifice inertial forces dominate the viscous forces when the Reynolds number is significantly larger than 1. If the sensing mass is a cylindrical piston then inertial forces also will dominate viscous forces when turbulent flow exists in the clearance between the piston and the cylinder, that is, when the Reynolds number is larger than about 2,000. In the case of a sphere in a tube, an intermediate situation exists. The annular orifice is not a sharp edged orifice requiring the Reynolds number to be less than 1, but neither is it a long, smooth channel permitting the use of Reynolds numbers up to 2,000. Extensive experiments have been conducted which indicate that at Reynolds numbers of about 25 and below, viscous flow predominates and that at Reynolds numbers of about 300 and above inertial flow dominates. At Reynolds numbers between about 25 and 300, both effects are present. In the design of the sensor, therefore, it is desirable to maintain the Reynolds number in the viscous range for at least the greater portion of the piston travel.

A consideration of the ratio of inertial to viscous forces will yield the following expression for the Reynolds number:

$$Re = \frac{R\dot{X}}{2v} \qquad [2]$$

where:

$v$ = kinematic viscosity of the gas

The Reynolds number here is written in terms of the sphere velocity for a steady state case. Since the sphere velocity not only is due to flow of the fluid from one side of the piston to the other, but also to the expansion of the fluid behind the sphere, equation [2] must be combined with equation [1] to relate the Reynolds number to the pressure drop rather than to the sphere velocity.

A computer program has been written to analyze the dynamics of this sensor. The approach used was that of a time transient wherein the dynamics of the sphere are calculated assuming the forces and pressures are constant, and the sphere is considered held fixed in space while the flow of the fluid is calculated. The pressures due to both effects are then calculated and the process repeated for another time step. If the time step chosen is sufficiently small, this technique will accurately represent the dynamics of the system. The same technique permits the use of an arbitrary acceleration input. In this manner, the sphere can be followed throughout time regardless of the acceleration input and including the effects of the bias mass.

By proper selection of the piston and cylinder materials the clearance between the sphere and cylinder can be varied so as substantially to eliminate the effects of the variation in gas viscosity due to temperature changes. The materials used for the sensing piston and the cylinder depend on the particular design of the device. In any case, the thermal expansion coefficients of the two materials must be such as to provide for a larger expansion of the cylinder than of the sensing piston so as to change the clearance between the piston and cylinder to compensate for the viscosity change of the gas used. Satisfactory results have been obtained with a sensor of the kind shown in FIGS. 1 and 2 wherein the cylinder 5 is composed of borosilicate glass, the spherical mass 7 is composed of Invar nickel iron alloy, the diametral clearance between the mass and the cylinder is 0.0012 inch, and the travel of the mass is 0.2 inch.

In some sensors a spherical sensing member is used whereas in others a cylindrical member will suffice. A spherical member is preferable when large acceleration components are present in the plane normal to the sensitive axis, whereas for a larger unit, such as the pyrotechnic unit of FIG. 4, a cylindrical sensing piston is preferable since the Reynolds number for a spherical piston would be sufficiently large to cause inertial flow effects to take place in the clearance. When a cylindrical piston is used, provision is made to maintain the orientation of the piston with respect to the cylinder. This is accomplished in the pyrotechnic unit shown in FIG. 4 by cocking the piston relatively to the cylinder.

Other geometric configurations for the piston can be chosen. However, to minimize the effect of acceleration components which lie in a plane normal to the longitudinal axis of the sensor, a spherical sensing mass is preferred. Friction forces will cause variations in the characteristic of the bias mass, but these variations can be tolerated since the friction forces are low enough to prevent the bias mass from continuing to contact the sensing mass once the bias acceleration has been exceeded.

Although almost any gas may be used in a particular crash sensor, helium is preferred since its kinematic viscosity is one of the highest of common gases, thereby minimizing inertial effects when a spherical piston is used.

In each of the crash sensors illustrated herein the dominant force opposing the motion of the sensing mass is that provided by the pressure drop across the sensing mass. This pressure drop, coupled with the flow of the gas, gives rise to a damping force which is approximately proportional to the velocity of the sensing member. For a typical crash pulse which, for example, involves a velocity change of 10 m.p.h. over a period of 0.02 second, the damping force exceeds that of the bias mass and spring during a substantial portion of the travel of the sensing mass.

I claim:

1. A gas damped sensor adapted to be mounted on a vehicle having a normally inactive passenger protective device for sensing deceleration above a predetermined threshold of such vehicle, said sensor comprising a sealed housing containing a gas; means defining a cylinder in said housing; sensing means mounted in said cylinder for movement in one direction from a normal position in response to deceleration of the vehicle, said sensing means and said cylinder having a clearance therebetween through which the gas may flow; yieldable biasing means exerting a predetermined force on said sensing means and preventing movement of the latter in said one direction from said normal position until said predetermined force of said biasing means is overcome; operating means for operating said device; and actuating means coupled to said operating means and responsive to movement of said sensing means a predetermined distance in said one direction from said normal position to actuate said operating means, the clearance between said cylinder and said sensing means being of such size that gas flow through said clearance is viscous and said gas is enabled to exert a damping force on said sensing means which dominates the force of said biasing means over a substantial portion of the movement of said sensing means in said one direction.

2. A sensor according to claim 1 wherein said sensing means is spherical.

3. A sensor according to claim 1 wherein said sensing means is cylindrical.

4. A sensor according to claim 1 wherein said gas is helium.

5. A sensor according to claim 1 wherein said gas is air.

6. A sensor according to claim 1 wherein said biasing means comprises a spring.

7. A sensor according to claim 1 wherein said biasing means comprises a spring and a mass interposed between said spring and said sensing means.

8. A sensor according to claim 1 wherein said actuating means comprises electrically conductive switch contacts.

9. A sensor according to claim 8 wherein said sensing means is electrically conductive and is engageable with said contacts.

10. A sensor according to claim 1 wherein said actuating means comprises a pyrotechnic charge.

11. A sensor according to claim 1 wherein said actuating means includes means for detonating said charge.

12. A sensor according to claim 11 wherein the detonating means comprises firing pin means normally spaced from and biased toward said charge, said firing pin means and said sensing means having cooperable means normally maintaining said firing pin means spaced from said charge.

13. A sensor according to claim 1 wherein said cylinder is composed of a material having a higher coefficient of thermal expansion than the material from which said piston means is formed.

14. A gas damped sensor adapted to be mounted on a vehicle having a normally inactive passenger protective device for sensing deceleration of such vehicle above a predetermined threshold, said sensor comprising a sealed housing containing a gas; means defining within said housing a cylinder having a bore; sensing means mounted in the bore of said cylinder for movement from a normal position adjacent one end thereof toward and beyond the opposite end of said cylinder in response to deceleration of the vehicle, said cylinder having a length less than that of said housing but at least as great as the corresponding dimension of said sensor; said sensing means and cylinder having a clearance therebetween through which the gas may flow and of such size that movement of said sensing means from said normal position is damped by said gas; yieldable biasing means exerting a predetermined force on said sensing means and preventing movement of the latter from said normal position until said predetermined force is overcome; means carried by said housing and establishing within the latter a chamber adjacent said opposite end of said cylinder and into which said sensing means is movable from said cylinder, the volume of said chamber being greater than the volume of the bore of said cylinder whereby movement of said sensing means accelerates following entry into said chamber; and means responsive to movement of said sensing means into said chamber to operate said device.

15. A sensor according to claim 14 wherein said sensing means is spherical.

16. A sensor according to claim 14 wherein said sensing means is cylindrical.

* * * * *